United States Patent [19]

Krappitz et al.

[11] Patent Number: 4,919,589

[45] Date of Patent: Apr. 24, 1990

[54] APPARATUS FOR SUPPLYING A STACK OF CARTON BLANKS FORM A PALLET TO THE MAGAZINE OF A CARTON-PACKING MACHINE

[75] Inventors: Heinz Krappitz, Bredenhorn; Herbert Wölfel, Bayreuth; Johannes Wolfrum, Himmelkron, all of Fed. Rep. of Germany

[73] Assignee: B.A.T. Cigarettenfabriken GmbH, Hamburg, Fed. Rep. of Germany

[21] Appl. No.: 271,683

[22] Filed: Nov. 16, 1988

[30] Foreign Application Priority Data

Nov. 23, 1987 [DE] Fed. Rep. of Germany ..... 3739659

[51] Int. Cl.[5] ..... B65G 57/01; B65H 1/02

[52] U.S. Cl. ..... 414/798.9; 414/416; 414/795.9; 414/797.2

[58] Field of Search ..... 414/788.4, 798.9, 797.2, 414/796.5, 797.3, 416, 795.8

[56] References Cited

U.S. PATENT DOCUMENTS

| | | | |
|---|---|---|---|
| 4,049,260 | 9/1977 | Szymborski | 414/788.4 X |
| 4,249,847 | 2/1981 | Tokuno | 414/798.9 |
| 4,613,268 | 9/1986 | Capdeboscq et al. | 414/796 |

FOREIGN PATENT DOCUMENTS

033799A1 8/1981 European Pat. Off. .

3001733A1 7/1981 Fed. Rep. of Germany .

*Primary Examiner*—Robert J. Spar
*Assistant Examiner*—Janice Krizek
*Attorney, Agent, or Firm*—Kerkam, Stowell, Kondracki & Clarke

[57] ABSTRACT

An apparatus for supplying a stack of carton blanks from a pallet to the magazine of a carton-packing machine in which the carton blanks are arranged vertically adjacent to each other, in particular for the tobacco industry, comprises an unloading carriage which is pivotable about a horizontal axis from a substantially vertical position into a substantially horizontal position and has an unloading fork which is movable along the unloading carriage and the prongs of which in the vertical position of the unloading carriage and thus in the horizontal position of the unloading fork can be inserted beneath the stack into the gaps between the boards at the upper side of the pallet. A drive displaces the unloading carriage and thus the prongs in the direction of the gaps between the boards at the upper side of the pallet; a retaining device provided on the unloading carriage holds, in the substantially horizontal position of said unloading carriage, the stack of carton blanks in the vertical position; a conveyor for the transfer of the individual blanks from the unloading carriage to the magazine is integrated into the unloading carriage.

12 Claims, 8 Drawing Sheets

APPARATUS FOR SUPPLYING A STACK OF CARTON BLANKS FORM A PALLET TO THE MAGAZINE OF A CARTON-PACKING MACHINE

BACKGROUND OF THE INVENTION

1. Field of the Invention

The invention relates to an apparatus for supplying a stack of carton blanks from a pallet to the magazine of a carton-packing machine in which the carton blanks are arranged vertically adjacent to each other.

2. Description of the Prior Art

In particular in the tobacco industry, but also in other fields of packing technology, carton blanks are delivered on pallets in such a manner that the folded-out, still flat carton blanks are stacked horizontally one above the other. The individual blanks are then removed from this stack and supplied to the magazine of the carton-packing machine.

Attempts have already been made to automate the individual steps of the blank supply; thus German Offenlegungsschrift 3,001,733 discloses an apparatus for filling a blank magazine with carton blanks in which a reserve magazine with a stack of horizontally disposed carton blanks is arranged vertically above the actual magazine of the carton-packing machine. From the stack of the reserve magazine the individual carton blanks drop vertically downwardly into the magazine so that the latter is continuously filled with carton blanks up to a predetermined height. This apparatus is not suitable for transferring carton blanks from a pallet.

Furthermore, published European patent application 33,799 discloses an apparatus for removing carton blanks from a blank stack in which the entire blank stack including its support is pivotable about a horizontal axis so that the individual carton blanks are disposed on each other and thereby spread out in the manner of a fan. The respective lowermost carton blank lies on a conveying means so that the carton blanks are carried away individually from below and placed on a stack from where they are again individually withdrawn from below. However, this apparatus also cannot be used to transfer a stack of carton blanks from a pallet because the necessary pivot movement of the pallet with the blank stack is problematical. In addition, this apparatus requires a lot of space.

It is therefore still usual to remove individually by hand carton blanks arranged in a stack on a pallet and to place said blanks in vertical position into the magazine of the carton-packing machine. This manual loading is, however, tedious and complicated; in addition, the working speed of the carton-packing machine can vary at any time because it depends inter alia, on the production speed of the product to be packaged and is influenced, for example, by production interruptions. There is no continuous predetermined rhythm for feeding the carton blanks to the carton-packing machine so that the magazine must be constantly observed and filled up again when necessary.

SUMMARY OF THE INVENTION

The invention is therefore based on the problem of providing an apparatus for supplying a stack of carton blanks from a pallet to the magazine of a carton-packing machine in which the aforementioned disadvantages do not occur. In particular, an apparatus is to be proposed which can be integrated into the carton-packing machine and when necessary automatically loads the magazine of the carton-packing machine with the carton blanks from the pallet.

The invention solves this problem by an improvement comprising an unloading carriage pivotable about a horizontal axis out of a substantially perpendicular position into a substantially horizontal position and having an unloading fork movable along the unloading carriage, the prongs of said fork in the vertical position of the unloading carriage and thus in the horizontal position of the unloading fork being insertable beneath the stack into the gaps between the boards at the upper side of the pallet, a drive means displacing the unloading carriage and thus the prongs of said fork in the direction of the gaps between the boards and the upper side of the pallet, and a conveying means integrated into the unloading carriage for the transfer of the individual blanks from the unloading carriage to the magazine.

Expedient embodiments are defined by the features of the subsidiary claims.

The advantages achieved with the invention are based on the fact that by means of a very compact apparatus, thus requiring only little space, the blank stack is lifted from the pallet, pivoted through 90° and thereby brought into such a position that the individual carton blanks now held in the vertical position, i.e. a position exactly plumb to the earth, can be supplied to the magazine of the carton-packing machine individually and thus in accordance with the requirements. By corresponding conception of the travelling movement of the unloading carriage in conjunction with the conveying means for the pallet it is also possible to lift two blank stacks consecutively off the pallet. After removal of the second blank stack the pallet must be replaced by a new pallet with blank stacks. Adequate time is available for this purpose, especially since the actual supply apparatus serves as a sort of buffer between the blank supply on the pallet on the one hand and the magazine of the carton-packing machine on the other, i.e. the new pallet must arrive in the removing position at the latest when (a) all the blanks have been taken from the buffer and (b) the magazine of the carton-packing machine is also substantially empty.

As mentioned, it is expedient to place each pallet on a conveying means, generally roller conveyors, so that the pallet can be brought into the actual removal position. For aligning the or each pallet in the removal position, centering rails and a transverse pushing means are provided on the conveying means which push the pallets during their transport perpendicularly to their transport direction and bring said pallet exactly into the removal position.

In this position the prongs of the removal fork, the dimensions and spaces of which are adapted to the gaps between the boards in the upper side of the pallet, engage into the clearances formed by the gaps between the lowermost blank of the stack and the pallet so that the blank stack as a whole can be lifted off the pallet, transported away and finally pivoted by a pivotal movement of the removal carriage about approximately 90° into a position in which the individual blanks of the stack are in the vertical position. The blanks are then held on one side by the removal fork and on the opposite side by a retaining means which can be formed for example by a pneumatically actuable cylinder or by a retaining roller.

When a cylinder is used, said cylinder is lifted in accordance with the demand for blanks by the carton-packing machine so that the respective foremost carton blank drops forwardly into the magazine of the carton-packing machine. It must be ensured here that not all the carton blanks fall forward at the same time; consequently the cylinder is moved forwardly only a certain distance synchronously to the rhythm of the machine and entrains at least the foremost carton blank whilst the remaining carton blanks are retained by a further retaining means, for example a brush lying on the upper edge of the carton blanks.

With this construction of the retainIng means, in a preferred embodiment the unloading carriage is not pivoted into the horizontal position but is kept in a somewhat inclined or oblique position in which the carton blanks engage by their own weight the unloading fork.

It is alternatively possible to pivot the unloading carriage into the horizontal position so that the foremost carton blanks assume a slightly inclined or oblique position wIth respect to the vertical and bear on the retaining roller.

If the conveying means provided at the unloading carriage, generally a conveying belt, is now set in motion the lower edge of the foremost carton blanks will be entrained and said blanks will drop down below the retaining roller onto the conveying means of the magazine of the carton-packing machine.

BRIEF DESCRIPTION OF THE DRAWINGS

The invention will be explained in detail hereinafter with reference to examples of embodiment with the aid of the attached schematic drawings, wherein.

DESCRIPTION OF THE PREFERRED EMBODIMENT

Figure 1:
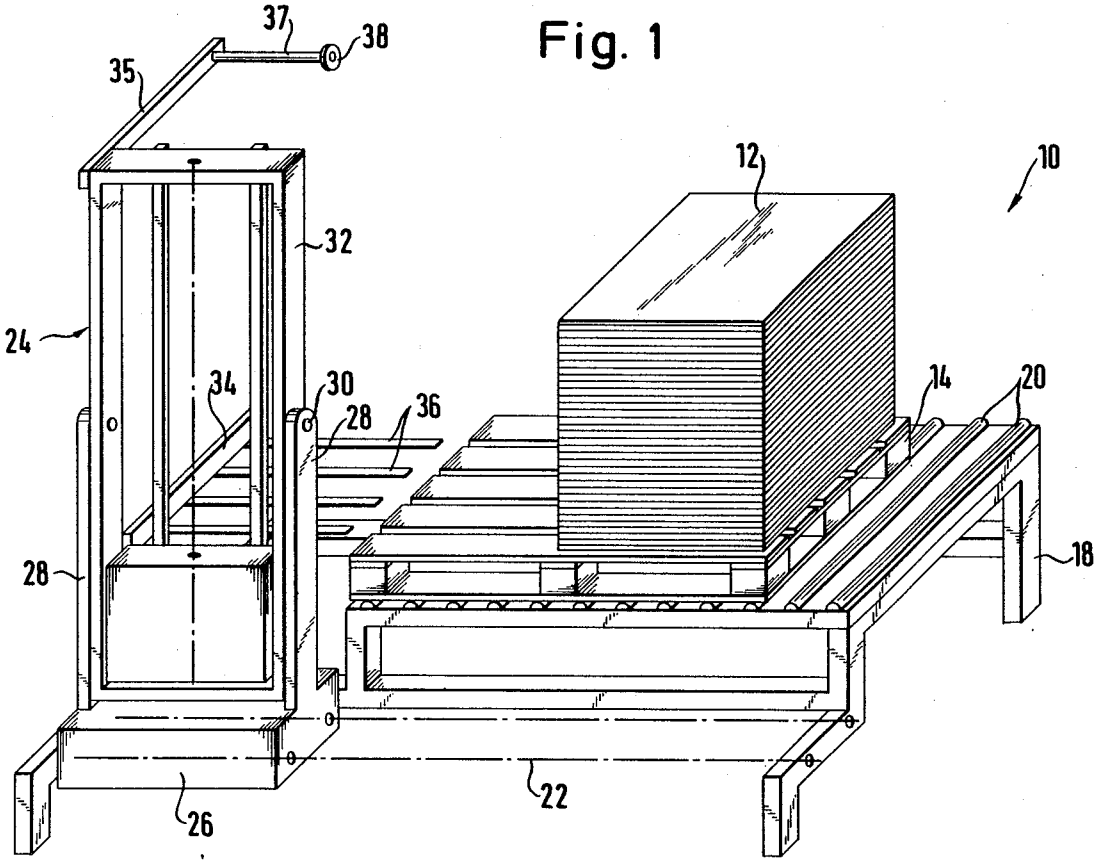
FIG. 1 is a perspective view of an apparatus for supplying stacks of carton blanks from one pallet to the magazine of a carton-packing machine, only one stack of carton blanks being shown on the pallet.

The apparatus shown in the Figures and denoted generally by the reference numeral 10 serves for supplying one stack 12 of carton blanks from a pallet 14 to the magazine 16 of a carton-packing machine (not shown) and comprises a base 18 into which a roller conveyor 20 with driven rollers is integrated. On the roller conveyor 20 (see FIG. 2) a pallet 14 having two stacks of dispatch-carton-blanks can be deposited by means of a driverless transport system, a fork truck or lifting truck and then brought into the removal position shown in the Figures.

In the base 18 a chain drive 22, indicated schematically in FIG. 1, for a removal means 24 is arranged parallel to the conveying direction of the pallet 14 with the two blank stacks 12 on the roller conveyor 20 so that the removal means 24 can be reciprocated parallel to the conveying direction of the pallets 14 adjacent the roller conveyor 20.

The removal means 24 comprises a base member 26 coupled to the chain drive 22 and having two vertical supports 28 which at their upper ends carry an unloading carriage 32 pivotable about a horizontal axis 30. As apparent from FIG. 1 the unloading carriage 32 is formed substantially by a frame-like structure which at one end, the upper end in the illustration of FIG. 1, is formed with a projecting rod 35 which carries a rod 37 projecting perpendicularly to rod 35 and having a retaining roller 38 still to be explained.

Figure 3:
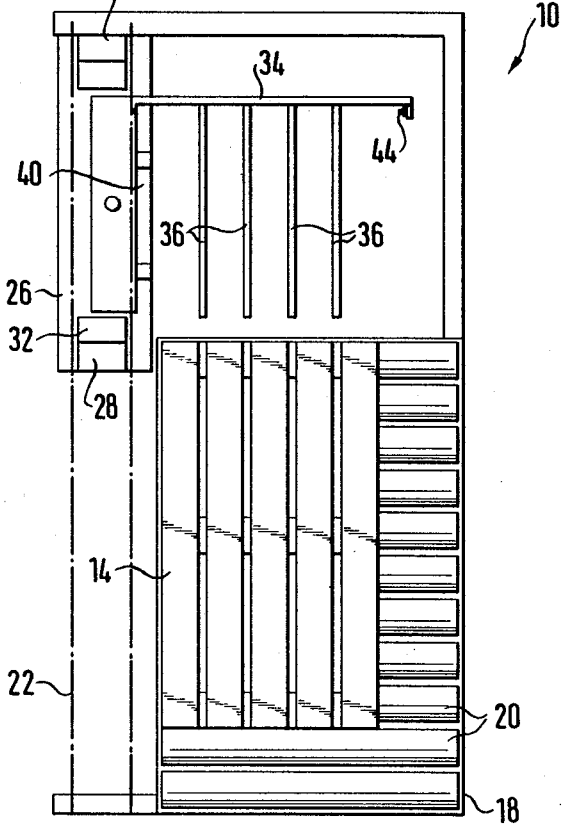
FIG. 3 is a plan view of the apparatus according to FIGS. 1 and 2 containing one pallet without blank stack.

At the opposite end an unloading fork 34 projects perpendicularly from the frame-like structure of the unloading carriage 32 and in the embodiment illustrated has four prongs 36 (see FIG. 3), the spacings and dimensions of which are adapted to the gaps between the boards at the upper side of the pallet 14. The pallets 14 are standardized industrial and Euro pallets; both types of pallets can be used on the apparatus by correspondingly adapting the pitch of the fork and the pallet delivery.

Figure 4:
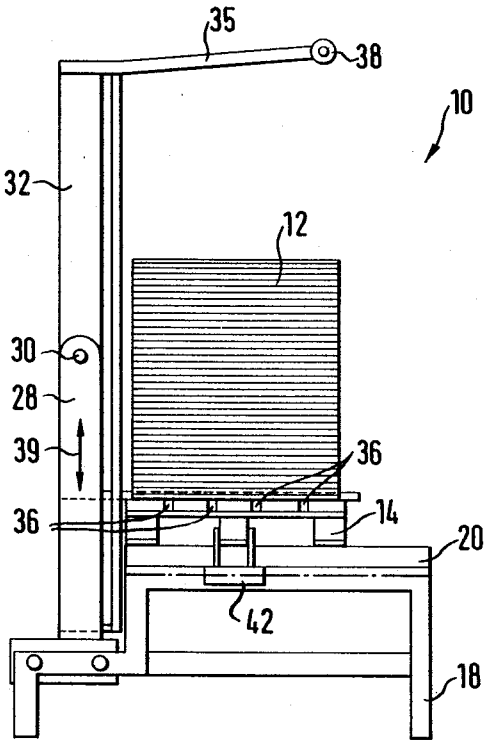
FIG. 4 is a side view of the apparatus according to FIGS. 1 to 3 containing one pallet with one blank stack.
Figure 5:
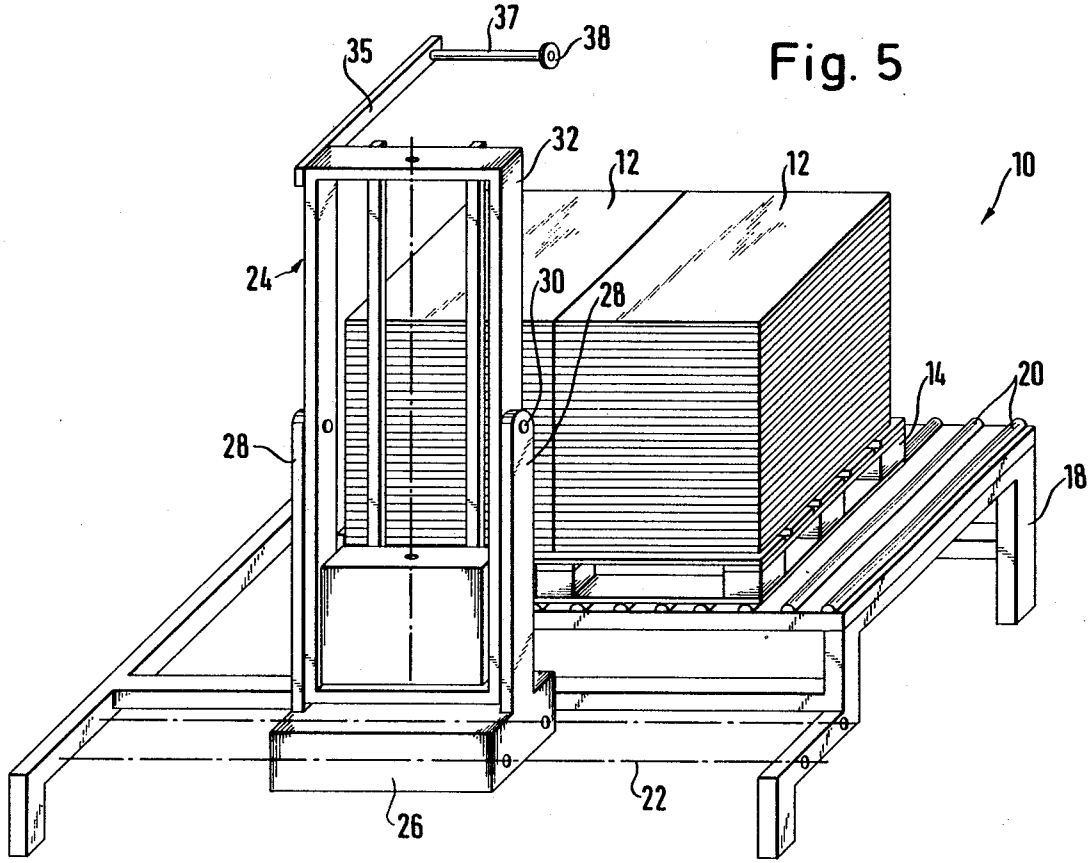
FIG. 5 is a perspective view of the apparatus corresponding to FIG. 2, the unloading fork of the unloading carriage having been moved beneath the blank stack and raised for the removal of said stack.
Figure 6:
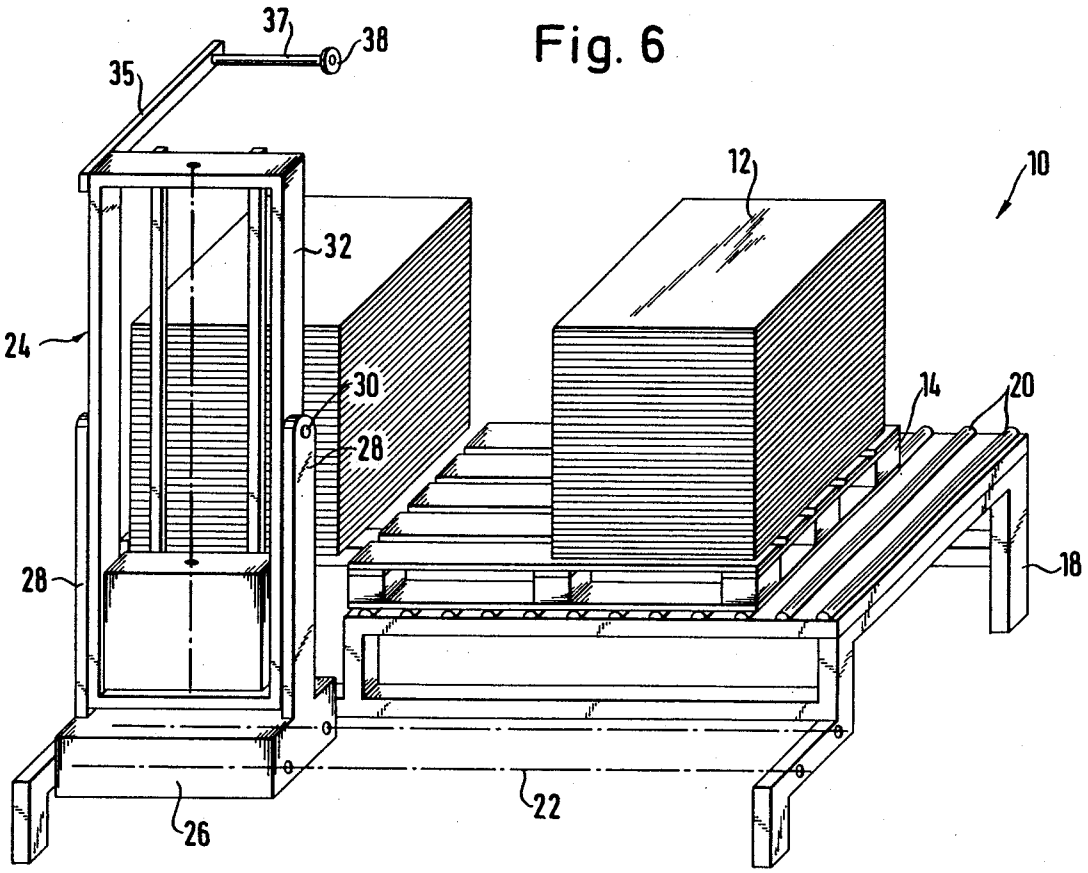
FIG. 6 is a view of the apparatus corresponding to FIG. 2 with the blank stack removed from the pallet.

The unloading fork 34 can be moved in the direction shown by arrow 39 in FIG. 4 by means of a spindle drive indicated schematically in FIG. 5 along the frame-like structure of the unloading carriage 32, the guidance being via a linear ball bushing (not shown). In the position of the unloading carriage 32 shown in FIG. 1 this displacement of the unloading fork 34 results in a movement upwardly or downwardly whilst in the pivoted position of the unloading carriage 32 a substantially horizontal movement of the unloading fork 34 results.

Figure 8:
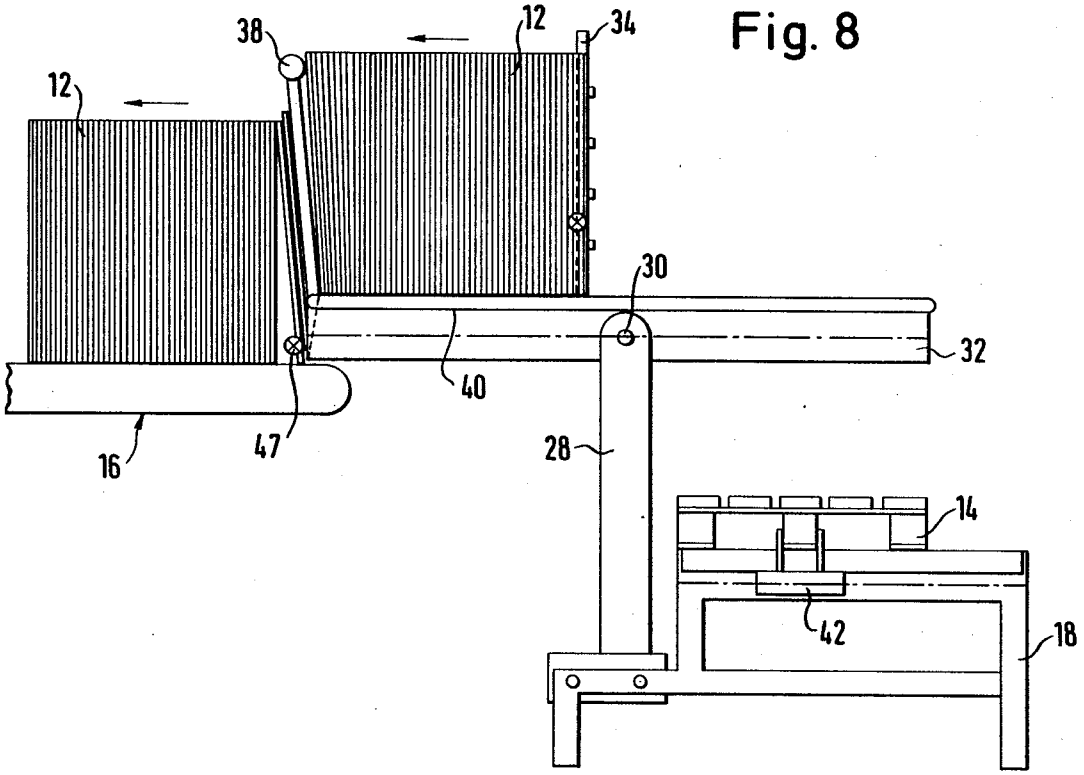
FIG. 8 is a side view of the apparatus with the unloading carriage pivoted into the horizontal position and a first embodiment of the retaining means.
Figure 9:
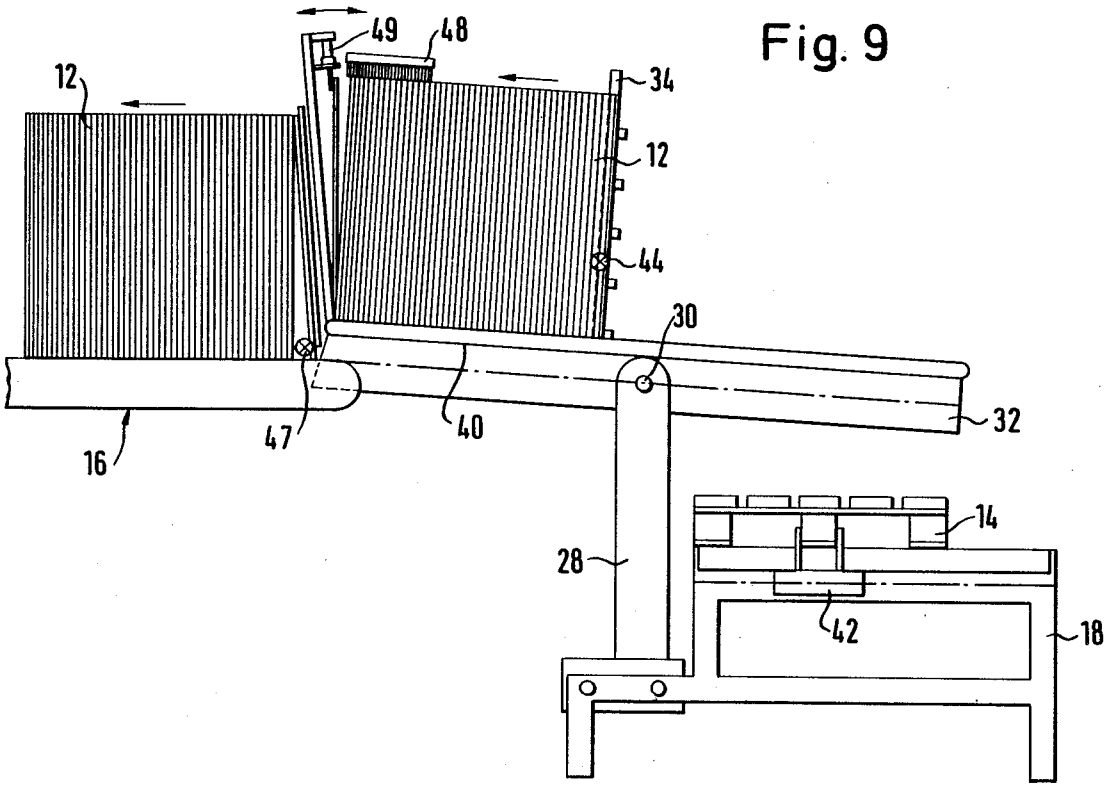
FIG. 9 is a side view of the apparatus with the unloading carriage pivoted into an inclined position and a second embodiment of the retaining means.

Furthermore, a conveying means 40 indicated schematically in FIGS. 8 and 9 formed, for example, by a conveying belt is integrated into the unloading carriage 32 and furnishes a transport movement in the plane of the unloading carriage 32 as indicated by the arrows in FIGS. 8 and 9.

On the apparatus 10, in particular on the actual removal means 24, various sensors, generally light barriers, are provided and control the individual functions in a manner still to be explained.

As apparent from FIG. 4 a schematically indicated pallet-centering device comprising a transverse pushing means 42 is integrated into the roller conveyor 20 so that the pallets 14 placed on the roller conveyor 20 can be shifted perpendicularly to their conveying direction and thereby brought into the correct removal position. The transverse pushing means 42 can be adjusted via a spindle drive (not shown).

Hereinafter the mode of operation of the embodiment according to FIGS. 1 to 8 will be discussed.

As already mentioned, at the beginning one pallet 14 with two blank stacks 12 is placed on the roller conveyor 20 and then brought by means of the roller conveyor 20 on the one hand and the transverse pushing means 42 on the other into the removal position shown in the Figures. In FIG. 1 the removal position of the pallet 14 is represented by a single stack 12, rendering visible the horizontal prongs 36 of the removal fork 34 with the removal carriage 32 in the vertical position.

Figure 2:
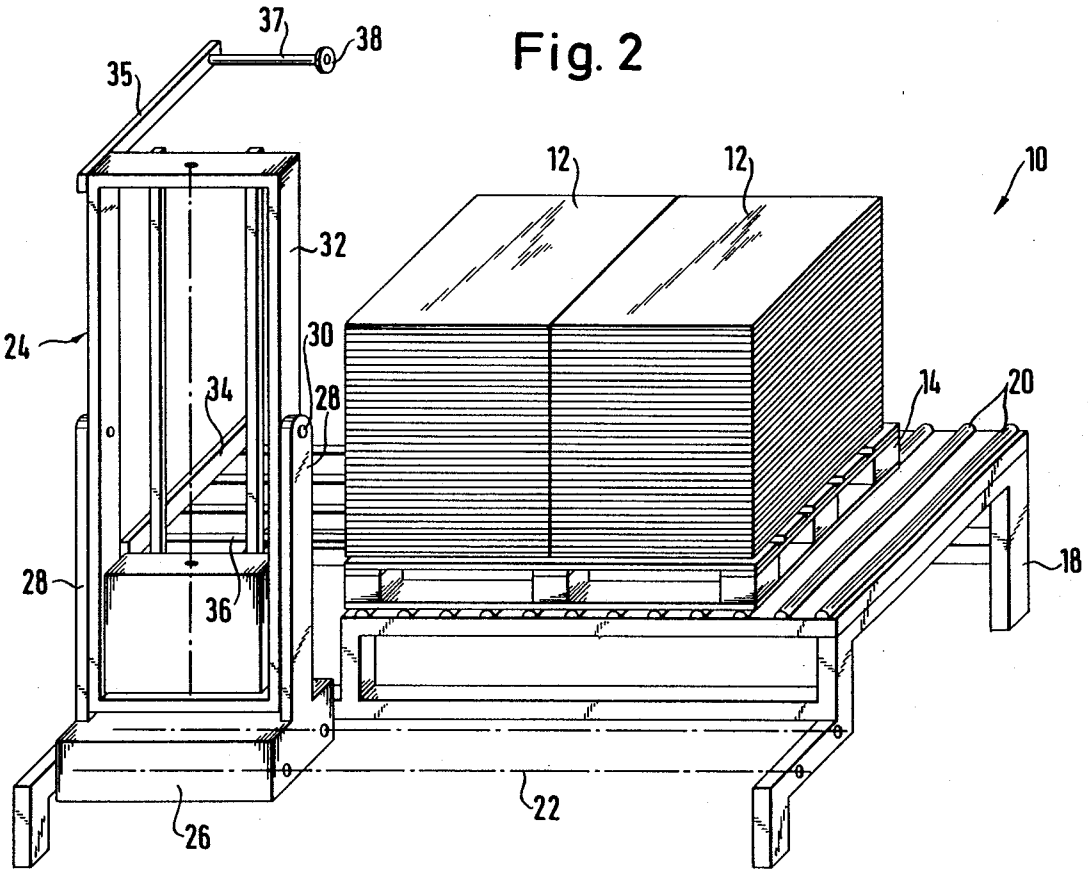
FIG. 2 is a perspective view corresponding to FIG. 1 of the apparatus with one pallet containing two stacks of carton blanks.

As soon as the pallet 14 with the blank stacks 12 has reached the removal position, as can be monitored if necessary by sensors (not shown), the removal means 24 with the removal carriage 32 is also in the position apparent from FIGS. 1 and 2, i.e. the prongs 36 of the removal fork 34 lie in a horizontal plane at the level of the gaps between the upper boards of the pallet 14. The base member 26 of the removal means 24 is now displaced to the right in accordance with the illustration in FIGS. 1 and 2, the prongs 36 thereby moving into the gaps between the upper boards of the pallet 14 and beneath the left blank stack according to the illustration of FIG. 2, as shown in FIG. 5. A light barrier 44 (see FIG. 3) monitors this movement and responds when the leading edge of the stack 12 reaches the end of the prongs 36.

On removal of the right blank stack 12 shown in FIG. 1 the removal means 24 must of course move further to the right until the prongs 36 are located beneath said stack 12.

Figure 7:
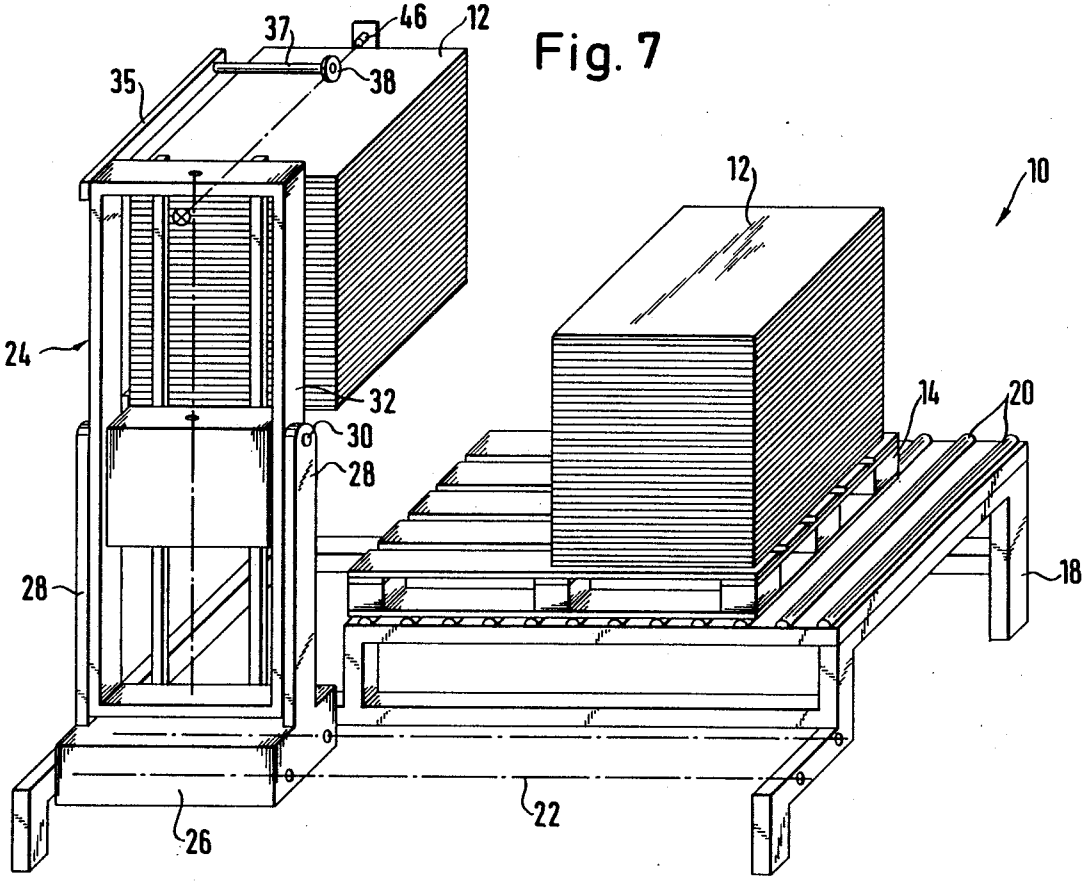
FIG. 7 is a view of the apparatus corresponding to FIG. 2 with raised blank stack.

The lifting means for the unloading fork 34 is now briefly set in operation so that the prongs 36 and thus also the left stack 12 of carton blanks are raised just above the upper edge level of the pallet 14. After raising of said stack 12 the removal means 24 again moves to its left end position shown in FIG. 6 so that the left stack 12 is now located adjacent and above the pallet 14. Then the lifting means is again set in operation so that the unloading fork 34 moves upwardly until the uppermost blank of the stack 12 has reached the highest position for pivoting and approaches the retaining roller 38 as shown in FIG. 7. This actual position is detected by means of a light barrier 46 indicated in FIG. 7.

In this upper end position the unloading carriage 32 is now turned counterclockwise as in the illustration of FIGS. 8 and 9 into a substantially horizontal position so that the individual carton blanks of the stack 12 assume substantially a vertical position; the carton blank which has formed the bottom of the stack 12 on the pallet 14 now lies on the vertical prongs 36 of the unloading fork 34 whilst the uppermost carton blank bears on the retaining roller 38 and is held in an approximately vertical position.

In the horizontal position of the removal carriage 32 shown in FIG. 8 the horizontal lower edge of the blank stack 12 is somewhat above the conveying means of the magazine 16 of the carton-packing machine.

The individual blanks of the stack 12 are also arranged vertically in said magazine 16. The conveying direction of the blanks in the magazine 16 is indicated in FIGS. 8 and 9 by the arrow.

Associated with the trailing edge of the stack 12 in the magazine 16 is a light barrier 47 which responds when the individual blanks in the magazine 16 have been removed to such an extent that the light beam of the light barrier 47 is no longer interrupted; this is an indication that blanks can again be supplied to the magazine 16 from the unloading carriage 32.

At this instant the conveying means 40 integrated into the unloading carriage 32 is actuated so that the lower edges of the blanks of the stack 12 are entrained and drop downwardly past the front edge of the conveying means 40, thereby the upper edges of the blanks slipping past the retaining means 38 move downwardly onto the convey means of the magazine 16. As soon as these new blanks have arrived the light barrier 47 responds again so that the conveying means 40 of the unloading carriage 32 is again stopped and thus the replenishment of the blanks is interrupted.

Synchronously with the movement of the conveying means 40 the unloading fork 34 is displaced to the left in the illustration of FIG. 8 until all the blanks have been transferred from the conveying means 40 of the unloading carriage 32 onto a conveying means of the magazine 16. The light barrier 44 provided at the unloading fork 32 detects the transfer of the last blank; as soon as said light barrier 44 responds thereto and the light beam of the light barrier 47 is not interrupted the unloading fork 34 is again driven into the right position according to the illustration of FIG. 8 and the unloading carriage 32 is pivoted back to its vertical position so that the starting position according to FIGS. 1 and 2 is again reached.

The right blank stack 12 according to the illustration in FIG. 1 can now be lifted in corresponding manner, only with associated greater displacement of the removal means 24, pivoted and then supplied to the magazine 16. FIG. 9 shows a modification of the retaining means for the left end of the stack 12 according to the illustration of said FIG. 9. In this case the retaining roller 38 is replaced by a pneumatically actuable cylinder 49 which can be reciprocated in the direction of the double arrow and is inserted in each case behind the foremost blank or at least behind the foremost blanks to supply them to the magazine 16 in conjunction with the displacement by the conveying means 40.

To prevent the unintentional sliding-up of the other blanks of the stack 12 a brush 48 bears on the upper edges of the front blanks and retains the other blanks of the stack 12 not engaged by the cylinder 49.

As soon as the second blank stack 12 has been raised, too, the empty pallet 14 is moved back on the roller conveyor 20 to the transfer point and a command for pallet exchange is generated or displayed; said pallet is then engaged by the driverless transport system, a fork truck or a lifting truck, and replaced by a new pallet 14 with two blank stacks.

We claim:

1. An apparatus for supplying a stack of carton blanks from a pallet to the magazine of a carton-packing machine in which the carton blanks are arranged vertically adjacent to each other, in particular for the tobacco industry, comprising an unloading carriage pivotable about a horizontal axis out of a substantially vertical position into a substantially horizontal position and having an unloading fork with prongs movable along the unloading carriage, a base member which is reciprocatable by means of a chain drive parallel to a direction in which the pallet is conveyed and in the direction of the gaps between boards at the upper side of the pallet and which comprises vertical supports on which the unloading carriage is pivotally mounted, the prongs of said fork in the vertical position of the unloading carriage and thus in the horizontal position of the unloading fork being insertable beneath the stack into the gaps between boards at the upper side of the pallet, a conveying means integrated into the unloading carriage for the transfer of the individual blanks from the unloading carriage to the magazine.

2. An apparatus according to claim 1, wherein a roller conveyor transports the pallet with the or each blank stack into a removal position.

3. An apparatus according to claim 2, wherein a transverse pushing means for aligning the pallet in said removal position is associated with the roller conveyor.

4. An apparatus according to claim 1, wherein the conveying means integrated into the unloading carriage is constructed as a conveyor belt.

5. An apparatus according to claim 1, wherein a spindle drive for the pivotal movement of the unloading carriage is integrated into the supports.

6. An apparatus according to claim 1, wherein sensors are provided for detecting the positions of the pallet or of the blank stack on the roller conveyor respectively, of the unloading carriage or of the unloading fork respectively, of the blank stack on the conveying means, of the unloading carriage and/or of the blank stack in the magazine.

7. An apparatus according to claim 6, wherein the movement sequences are controlled by the signals obtained from said sensors.

8. An apparatus according to claim 6, wherein said sensors are formed by light barriers.

9. An apparatus according to claim 1, wherein a retaining means provided on the unloading carriage holds in the substantially horizontal position of the unloading carriage the stack of carton blanks in a vertical position.

10. An apparatus according to claim 9, wherein the retaining means is formed by a freely rotatable retaining roller provided on the unloading carriage.

11. An apparatus according to claim 9, wherein the retaining means is formed by a reciprocatable pneumatic cylinder for withdrawing at least the foremost carton blank.

12. An apparatus according to claim 11 wherein a brush serving as additional retaining means lies on the foremost carton blanks which are disposed on the substantially horizontal unloading carriage.

* * * * *

UNITED STATES PATENT AND TRADEMARK OFFICE

CERTIFICATE OF CORRECTION

PATENT NO. : 4,919,589

DATED : April 24, 1990

INVENTOR(S) : Heinz KRAPPITZ, ET AL

It is certified that error appears in the above-identified patent and that said Letters Patent is hereby corrected as shown below:

In line 2 of the title on the patent face, and column 1, "FORM" should read -- FROM --.

Signed and Sealed this

Twenty-eighth Day of May, 1991

*Attest:*

HARRY F. MANBECK, JR.

*Attesting Officer*

*Commissioner of Patents and Trademarks*